US006401841B1

(12) United States Patent
Eilertsen

(10) Patent No.: US 6,401,841 B1
(45) Date of Patent: Jun. 11, 2002

(54) ROTARY TABLE

(75) Inventor: Bjørn Eilertsen, Hundvåg (NO)

(73) Assignee: Engineering and Drilling Machinery A.S., Stavanger (NO)

( * ) Notice: Subject to any disclaimer, the term of this patent is extended or adjusted under 35 U.S.C. 154(b) by 0 days.

(21) Appl. No.: 09/673,008

(22) PCT Filed: Apr. 7, 1999

(86) PCT No.: PCT/NO99/00114

§ 371 (c)(1),
(2), (4) Date: Oct. 5, 2000

(87) PCT Pub. No.: WO99/53168

PCT Pub. Date: Oct. 21, 1999

(30) Foreign Application Priority Data

Apr. 8, 1998 (NO) ..... 1645/98

(51) Int. Cl.[7] ..... E21B 3/04
(52) U.S. Cl. ..... 175/195
(58) Field of Search ..... 173/163–167, 173/152; 279/87, 121; 175/173, 114, 122, 195

(56) References Cited

U.S. PATENT DOCUMENTS 4,393,945 A 7/1983 Rassieur
5,029,655 A 7/1991 Ebeling
5,396,952 A 3/1995 Stogner

FOREIGN PATENT DOCUMENTS

EP 0 225 979 6/1987
GB 240439 9/1924

*Primary Examiner*—Robert E. Pezzuto
(74) *Attorney, Agent, or Firm*—Cowan, Liebowitz & Latman, P.C.; Michael I. Wolfson

(57) ABSTRACT

A rotary table for a drill string, including a stationary frame having a rotating part arranged therein, and hydraulic equipment such as hydraulic slips (wedge-shaped holding collars) and a hydraulic clamp on the rotating part, and also hydraulic power transmission between the stationary part and the rotating part. The hydraulic power transmission for each individual piece of hydraulic equipment includes a hydraulic motor (29, 30, 31) in the stationary frame (2), a hydraulic pump (17, 18, 19) in the rotating part (3), and a ring (11, 12, 13) provided with internal and external toothing, wherein the internal toothing is in driving engagement with a gearwheel (20, 21, 22) on an input shaft in the hydraulic pump and the external toothing is in driving engagement with a gearwheel (20, 21, 22) on an input shaft in the hydraulic pump and the external toothing is arranged for engageable and disengageable driving interaction with a gearwheel (24, 25, 26) on an output shaft in the hydraulic motor.

6 Claims, 3 Drawing Sheets

ROTARY TABLE

BACKGROUND OF THE INVENTION

The invention relates to a rotary table for a drill string as disclosed in the preamble of claim 1.

The rotary tables for drill strings that are common today are built having a stationary frame and a rotating part arranged therein. As a rule, a hydraulic clamp and one or two hydraulically operated slips (wedge-shaped holding collars) are mounted on the rotating part. In order to operate this hydraulic equipment, it is necessary to have hydraulic power transmission from the stationary part of the table to the rotating part.

Previously, this has been accomplished by using a hydraulic swivel which is mounted around the main shaft of the rotary table, the swivel having ports for transfer of the hydraulic medium. In practice, it has been found difficult to endow this swivel with a service life of any duration, as the seal rings used are quickly damaged by the substantial frictional heat which occurs during rotation.

It is an object of the invention to provide power transmission without the use of a swivel.

This object is achieved with the rotary table as disclosed in claim 1.

Additional features of the invention are disclosed in the dependent claims.

The invention allows the obtention of mechanical power transmission without any leakage problems. For each hydraulically operated working component. desired power transmission can be effected by means of a hydraulic motor and a hydraulic pump, but several sets of motor and pump working simultaneously on the same ring may also be used.

Each individual ring is rotatably supported in the rotating part, preferably by means of simple slide bearings. The gearwheels on the input shaft of the hydraulic pumps are in permanent driving engagement with the internal toothing of the respective ring whilst the driving interaction between the gearwheels on the output shafts of the hydraulic motors and the respective external toothing is capable of engagement and disengagement. Two-way couplings may be used for this engagement and disengagement, but a preferred embodiment is one in which the gearwheel is brought into and out of driving engagement with the external toothing, and an especially preferred embodiment is one in which the actual hydraulic motor is moved thereby bringing the associated gearwheel into and out of engagement with the external toothing. This motion may advantageously take place with the aid of a hydraulic working cylinder.

The hydraulic motors and working cylinders may be controlled from a control cabin and can be operated individually and in both directions, thereby enabling the hydraulic pumps which are connected to their respective units, either a clamp or slips, to operate these units in both directions.

A rotary table usually has several hydraulic main motors for the operation of the rotating part. It is therefore advantageous to provide the hydraulic system with an interlock in the control system to prevent the hydraulic main motors from being operated whilst the motors for clamps and slips are in operation.

BRIEF DESCRIPTION OF THE DRAWINGS

The invention will now be described in more detail, with reference to the drawings wherein.

DESCRIPTION OF THE PREFERRED EMBODIMENTS

Figure 1:
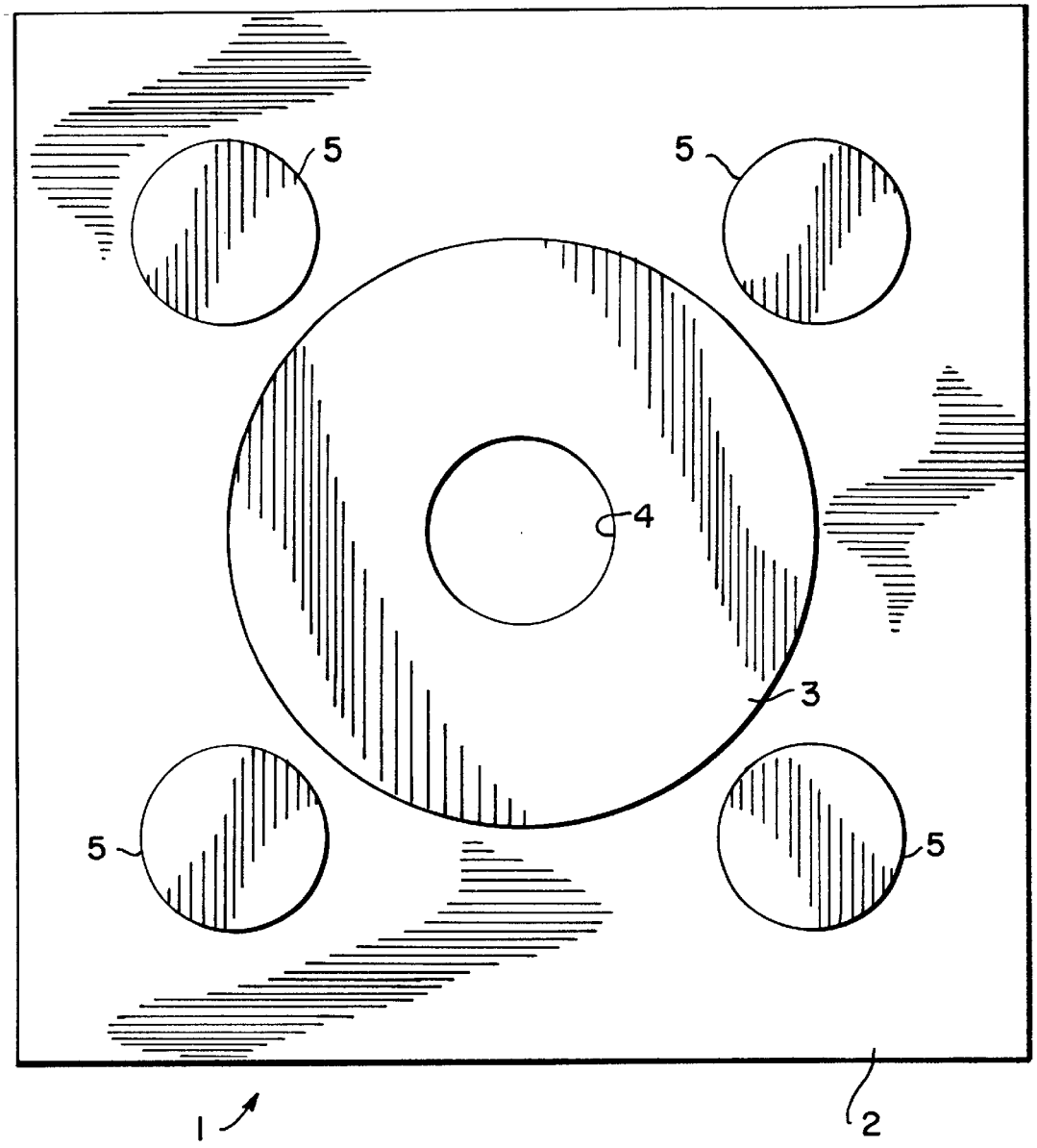
FIG. 1 is a schematic horizontal section through a rotary table.

FIG. 1 is a schematic horizontal section through a rotary table 1 having a,stationary frame 2 and a part 3 rotatably supported in the stationary part. There is an opening 4 in the rotating part for a non-illustrated drill string. Four hydraulic main motors 5 for the operation of the rotating part 3 are arranged on the stationary frame 2.

Figure 2:
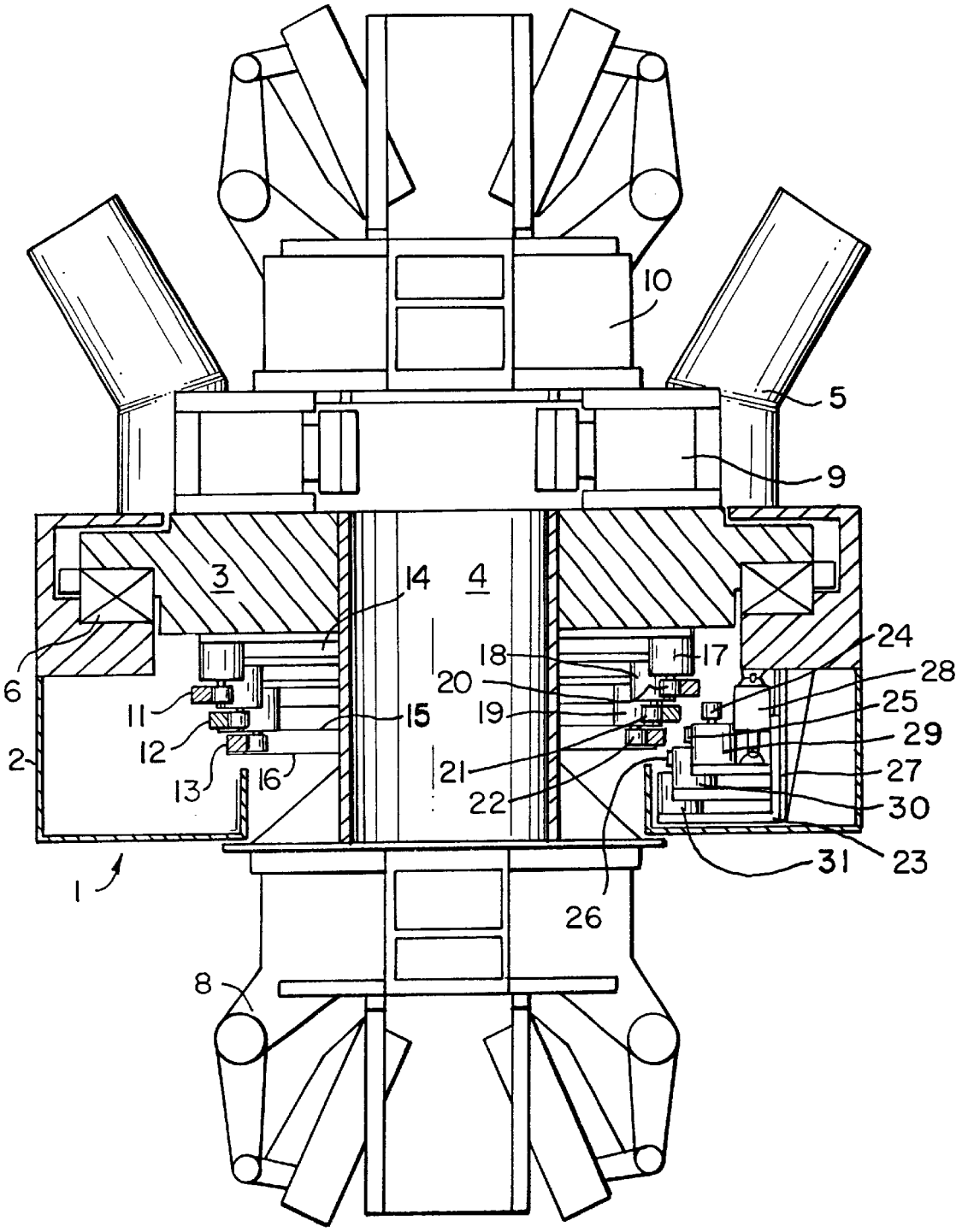
FIG. 2 is a schematic vertical section through a rotary table according to the invention.

FIG. 2 is a schematic vertical section through the rotary table 1. In the stationary frame 2 there is a slew ring bearing 6 for the rotating part 3. The rotating part 3 has an opening 4 for the non-illustrated drill string in the form of a tube 7 which extends into the stationary frame and at the bottom supports a slips means 8. On the top of the frame 2 the rotating part 3 has a hydraulic clamp 9 and an upper slips means 10. The hydraulic clamp and the upper slips are not shown in the horizontal section in FIG. 1.

The hydraulic equipment, the clamp 9 and the slips 8 and 10, are supplied with hydraulic power by a system including three gear rims or rings 11, 12 and 13. These are supported in a manner not shown in more detail on slide bearings 14, 15 and 16 mounted in the rotating part 3, so that they can rotate coaxially in the rotating part 3. Three hydraulic pumps 17, 18 and 19 are mounted in the rotating part 3. Each pump has an input shaft upon which there is arranged a gearwheel 20, 21, 22. These gearwheels are in driving engagement with internal toothing on a respective ring 11–13. Three hydraulic motors 29, 30 and 31 are placed on a carrier 23 in the stationary frame 2, each of which has on an output shaft a gearwheel 24, 25 and 26 respectively. The carrier 23 is slide-supported in a vertical guide 27 and can be moved up and down in this guide by means of a hydraulic working cylinder 28. The working cylinder is secured to the stationary frame 2 at its upper end and is attached to the carrier 23 at its it lower piston rod end. When the carrier is lifted by the working cylinder, the gearwheels 24–26 will be brought into driving engagement with external toothing on a respective ring 11–13. The rings 11–13 run freely in the slide bearings 14–16.

When the hydraulic motors 29–31 run, they will actuate the rings 11–13. The rings will in turn drive the three hydraulic pumps 17–19, which are attached to a respective hydraulic equipment component 8, 9, 10. The motors 29–31 may be driven individually and in both directions, allowing the equipment, clamp or slips, to be operated in both directions.

FIG. 1 shows a common carrier 23 for the hydraulic motors. Of course, a carrier with associated working cylinder may be provided for each motor.

Figure 3:
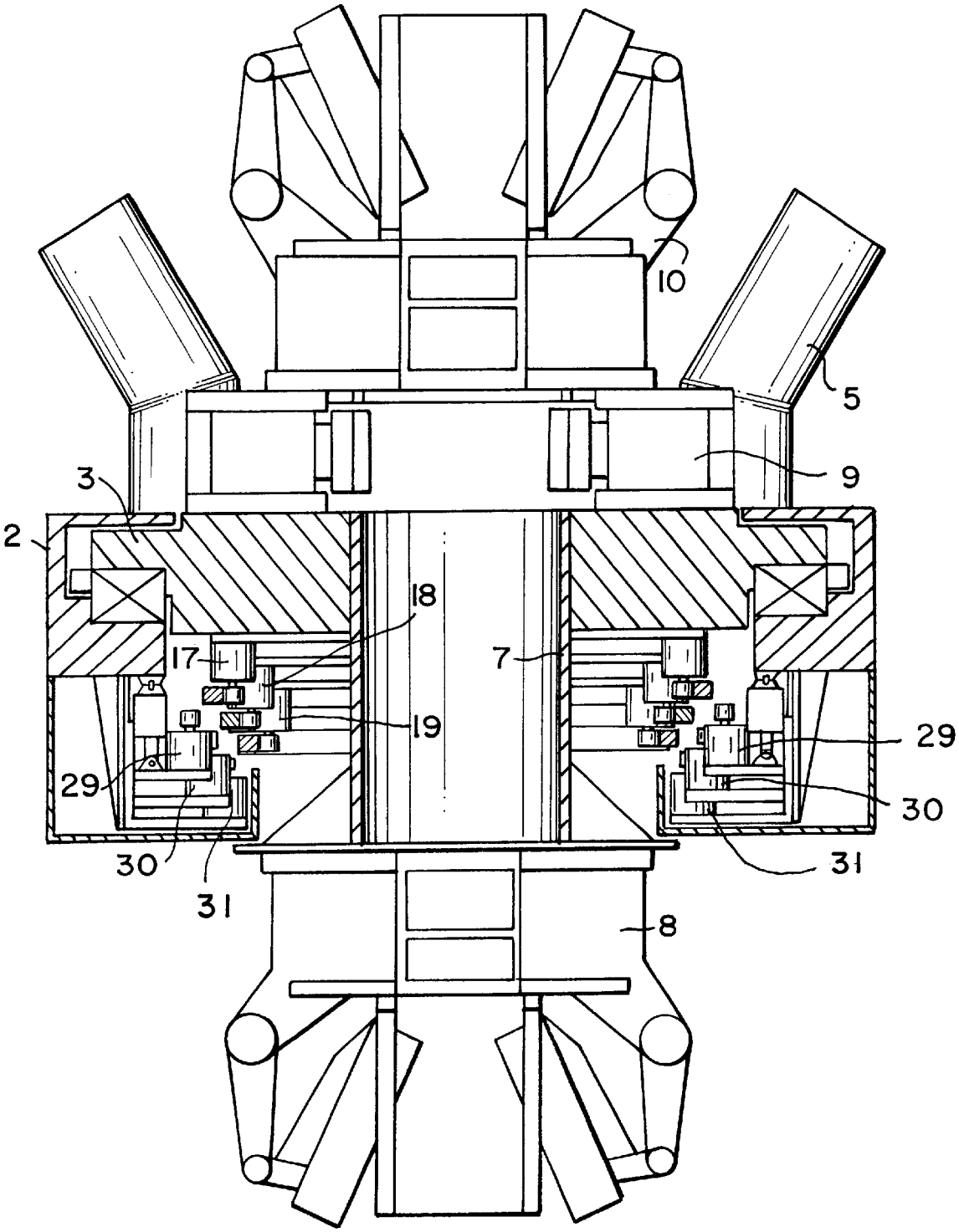
FIG. 3 is a schematic vertical section through a modified embodiment of the invention.

A variant wherein automatic control of the rings and a more uniform driving force is achieved is illustrated in FIG. 3, where the use of two diametrically positioned motors 29–30 and pumps 17–19 for each ring 11–13 is shown. In other respects the embodiment and its mode of operation are as described above in connection with FIG. 1.

It is not shown, but in the control system an interlock is installed which prevents simultaneous operation of the hydraulic main motors 5 and the motors 29–31.

What is claimed is:

1. A rotary table for a drill string, including a stationary frame having a rotating part arranged therein, and hydraulic slips (wedge-shaped holding collars) and a hydraulic clamp on the rotating part, and hydraulic power transmission between the stationary frame and the rotating part, comprising hydraulic transmission for each hydraulic slip and clamp including a hydraulic motor on the stationary frame, a hydraulic pump having an input shaft with a gearwheel on the rotating part, and a ring provided with internal and external toothing which is supported on the rotating part so as to be coaxially rotatable, wherein the internal toothing on the ring is in driving engagement with the gearwheel on an input shaft in the hydraulic pump and the external toothing on the ring is arranged for engageable and disengageable driving interaction with the hydraulic motor via the gearwheel on the output shaft of the hydraulic motor.

2. The rotary table according to claim 1, including means for bringing the gearwheel on the output shaft of the hydraulic motor into and out of driving engagement with the external toothing on the ring.

3. The rotary table according to claim 2, wherein the means for bringing the gear wheel into engagement actuates motion of the hydraulic motor.

4. The rotary table according to claim 2, characterized in that the means for bringing the gear wheel into engagement includes a hydraulic working cylinder.

5. The rotary table according to claim 1, wherein the ring is rotatably supported on a slide bearing.

6. The rotary table according to claim 1, including hydraulic main motors for operation of the rotating part, and an interlock in the hydraulic system to prevent the main motors from being operated when the hydraulic motor or motors are in operation.

* * * * *